US006171770B1

(12) United States Patent
Chen et al.

(10) Patent No.: US 6,171,770 B1
(45) Date of Patent: Jan. 9, 2001

(54) METHOD FOR APPLYING A PROTECTIVE OVERCOAT TO A PHOTOGRAPHIC ELEMENT

(76) Inventors: Jiann Chen, 11 Cambray Dr., Fairport, NY (US) 14450; Biao Tan, 343 State St., Rochester, NY (US) 14650; Muhammed Aslam, 98 Landstone Ter., Rochester, NY (US) 14606; Robert A. Lancaster, 167 Huffer Rd., Hilton, NY (US) 14468

( * ) Notice: Under 35 U.S.C. 154(b), the term of this patent shall be extended for 0 days.

(21) Appl. No.: 09/449,325

(22) Filed: Nov. 24, 1999

(51) Int. Cl.[7] ..... G03C 1/025

(52) U.S. Cl. ..... 430/531; 124/132; 124/131; 124/303

(58) Field of Search ..... 430/124, 131, 430/132, 531, 303; 432/59

(56) References Cited

U.S. PATENT DOCUMENTS

| | | | | |
|---|---|---|---|---|
| 2,173,480 | | 9/1939 | Jung . | |
| 2,259,009 | | 10/1941 | Talbot . | |
| 2,331,746 | | 10/1943 | Talbot . | |
| 2,706,686 | | 4/1955 | Hilborn . | |
| 2,798,004 | | 7/1957 | Weigel . | |
| 3,113,867 | | 12/1963 | Van Norman et al. . | |
| 3,190,197 | | 6/1965 | Pinder . | |
| 3,397,980 | | 8/1968 | Stone . | |
| 3,415,670 | | 12/1968 | McDonald . | |
| 3,443,946 | | 5/1969 | Grabhofer . | |
| 3,502,501 | | 3/1970 | Burczyk et al. . | |
| 3,697,277 | | 10/1972 | King . | |
| 3,733,293 | | 5/1973 | Gallagher et al. . | |
| 3,810,735 | * | 5/1974 | Moser | 432/59 |
| 4,027,073 | | 5/1977 | Clark . | |
| 4,092,099 | * | 5/1978 | Chiba et al. | 432/59 |
| 4,092,173 | | 5/1978 | Novak et al. . | |
| 4,171,979 | | 10/1979 | Novak et al. . | |
| 4,279,945 | | 7/1981 | Audran et al. . | |
| 4,302,523 | | 11/1981 | Audran et al. . | |
| 4,333,998 | | 6/1982 | Leszyk . | |
| 4,426,431 | | 1/1984 | Harasta et al. . | |
| 4,439,509 | | 3/1984 | Schank . | |
| 4,595,602 | | 6/1986 | Schank . | |
| 4,639,405 | * | 1/1987 | Franke | 430/124 |
| 4,923,775 | | 5/1990 | Schank . | |
| 4,999,266 | | 3/1991 | Platzer et al. . | |
| 5,089,363 | | 2/1992 | Rimai et al. . | |
| 5,124,755 | | 6/1992 | Hediger . | |
| 5,179,147 | | 1/1993 | Jones . | |
| 5,200,284 | | 4/1993 | Chen et al. . | |
| 5,233,008 | | 8/1993 | Chen et al. . | |
| 5,330,840 | | 7/1994 | Chen et al. . | |
| 5,362,833 | * | 11/1994 | Chen et al. | 528/25 |
| 5,386,281 | | 1/1995 | Mitani et al. . | |
| 5,447,832 | | 9/1995 | Wang et al. . | |
| 5,465,146 | | 11/1995 | Higashi et al. . | |
| 5,529,847 | | 6/1996 | Chen et al. . | |
| 5,731,117 | | 3/1998 | Ferrar et al. . | |
| 5,778,295 | * | 7/1998 | Chen et al. | 399/329 |
| 5,804,341 | | 9/1998 | Bohan et al. . | |
| 5,856,051 | | 1/1999 | Yau et al. . | |

OTHER PUBLICATIONS

Kirk–Othmer, Encyclopedia of Chemical Technology, 3rd Ed., vol. 20, pp. 940–962.

Lichtenwalner and Sprung, Bikales, Ed., Encyclopedia of Polymer Science and Technology, vol. 12, Interscience Publishers, (New York 1970) p. 464.

D. Sats, Handbook of Pressure Sensitive Adhesive Technology, 2nd Ed., pp. 601–609, Van Nostrand Reinhold (1989).

R.H. Glaser, G. L Wilkes, C.E. Bronnimann; *Journal of Non–Crystalline Solids,* 113 (1989) 73–87.

* cited by examiner

*Primary Examiner*—Richard L. Schilling
*Assistant Examiner*—Amanda C. Walke
(74) *Attorney, Agent, or Firm*—Doreen M. Wells; Lawrence P. Kessler

(57) ABSTRACT

A method of fusing a protective layer on a photographic element by the steps of: providing a photographic element having a silver halide light-sensitive emulsion layer; applying a hydrophobic polymeric coating to the silver halide light sensitive emulsion layer; and fusing the hydrophobic polymeric coating to the silver halide light sensitive emulsion layer to form a protective overcoat, the fusing step comprising: passing the photographic element through a nip formed between a heated fuser belt and a roller wherein the fuser belt has an overcoat containing an optional siloxane intermediate layer and a silsesquioxane polymer surface layer coated on said intermediate layer.

19 Claims, No Drawings

METHOD FOR APPLYING A PROTECTIVE OVERCOAT TO A PHOTOGRAPHIC ELEMENT

RELATED APPLICATIONS

Copending U.S. patent application Ser. No. 09/299291, filed Apr. 26, 1999, entitled "Method for Applying a Protective Overcoat to a Photographic Element Using a Fuser Belt", Ser. No. 08/667,270, filed Jul. 20, 1996, entitled "Overcoated Charge Transporting Elements and Glassy Solid Electrolytes", and Ser. No. 09/449,326, filed on even date herewith, entitled "Fusing Belt for Applying a Protective Overcoat to a Photographic Element" are related applications.

FIELD OF THE INVENTION

This invention relates to providing a protective overcoat on a photographic element by using a fuser belt.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by fingerprints, it can be scratched or torn and it can swell or otherwise deform when it is contacted with liquids.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. The application of UV-polymerizable monomers and oligomers on processed image followed by radiation exposure to form crosslinked protective layer is described U.S. Pat. Nos. 4,092,173, 4,171,979, 4,333,998 and 4,426,431. One drawback for the solvent coating method and the radiation cure method is the health and environmental concern of those chemicals to the coating operator. U.S. Pat. Nos. 3,397,980, 3,697,277 and 4,999,266 describe methods of laminating polymeric sheet film on the processed image as the protective layer. U.S. Pat. No. 5,447,832 describes the use of a protective layer containing mixture of high and low Tg latices as the water-resistance layer to preserve the antistat property of the V(2)O(5) layer through photographic processing. This protective layer is not applicable to the image formation layers since it will detrimentally inhibit the photographic processing. U.S. Pat. No. 2,706,686 describes the formation of a lacquer finish for photographic emulsions, with the aim of providing water- and fingerprint-resistance by coating the emulsion, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. U.S. Pat. No. 3,443,946 provides a roughened (matte) scratch-protective layer, but not a water-impermeable one. U.S. Pat. No. 3,502,501 provides protection against mechanical damage only; the layer in question contains a majority of hydrophilic polymeric materials, and must be permeable to water in order to maintain processability. U.S. Pat. No. 5,179,147 likewise provides a layer that is not water-protective.

U.S. Pat. No 5,856,051 describes an aqueous coatable, water-resistant protective overcoat that can be incorporated into the photographic product, allows for appropriate diffusion of photographic processing solutions, and does not require coating operation after exposure and processing. This was accomplished by applying a coating comprising hydrophobic polymer particles having an average size of 0.01 to 1 microns to the silver halide light-sensitive emulsion layer. The silver halide light sensitive emulsion layer is developed to provide an imaged photographic element. The hydrophobic polymer particles are then fused to form a protective overcoat. This patent did not however describe the composition of any suitable materials for fusing the hydrophobic polymer particles to form the protective layer.

One key requirement of the method for fusing the particles comprising the protective overcoat is that the desired gloss level of the original unprotected photographic element be maintained. In the field of electrophotography, belt fusers have been shown to yield images with gloss values comparable to photographic elements. The belt in the belt fusing system can be made of stainless steel or polyester and the outer surface of the fuser member can be aluminum, steel, various alloys, or polymeric materials, such as, thermoset resins and fluoroelastomers.

The background art of electrophotography discloses several broad classes of materials useful for fuser belts. For example, U.S. Pat. Nos. 5,089,363; 5,465,146; 5,386,281; 5,362,833; 5,529,847; 5,330,840; 5,233,008; 5,200,284 and 5,124,755 disclose fuser belt systems consisting of belts coated with silicone polymers. U.S. Pat. No. 5,089,363 discloses that metal belts coated with highly crosslinked polysiloxanes provide fused toner images having high gloss. U.S. patent application Ser. No. 09/299,291 discloses a fusing belt can be prepared by a highly crosslinked silicone resin, but it has been found that the highly crosslinked silicone resin is brittle and may crack when the fusing belt is repeatedly flexed. Therefore, there is still need for an improved belt coating formulation for forming a protective overcoat on a photographic element.

Commonly-assigned U.S. Pat. No. 5,804,341 describes an electrostatically bound water-resistant protective overcoat that can be attached into the finished photographic product. This was accomplished by electrostatically binding a coating comprising hydrophobic polymer particles having an average size of 3 to 10 microns on to the silver halide light-sensitive emulsion layer after silver halide light sensitive emulsion layer is developed to provide an imaged photographic element. The hydrophobic polymer particles are then fused to form a protective overcoat.

Through the recent advances in the development of protective overcoats for photographic elements; further materials are required to fuse the particulate polymers composing the protective overcoats described in U.S. Pat. Nos. 5,856,051 and 5,804,341 The prior art does not however describe the composition of any suitable materials for fusing the hydrophobic polymer particles to form the protective layer.

SUMMARY OF THE INVENTION

The present invention provides suitable materials to form the protective layer. These materials will be in the form of overcoated fusing belts which provide high gloss, long life and good release of the fused heat-softenable polymer images. The present invention provides an improved means for forming protective overcoats on a photographic element. The materials will be in the form of overcoated fusing belts which provide high gloss, longlife, and good release of the fused heat-softenable polymer images applying a hydrophobic polymeric coating over the silver halide light sensitive emulsion layer.

The present invention provides a method of forming a protective overcoat on a photographic element comprising:

(a) providing a photographic element having a silver halide light-sensitive emulsion layer;

(b) applying a hydrophobic polymeric coating over the silver halide light sensitive emulsion layer;

(c) fusing the hydrophobic polymeric coating to the photographic element over the silver halide light sensitive emulsion layer to form a protective overcoat by:

passing the photographic element through a nip formed between a heated fuser belt having a resin made by curing a composition including siloxanes and a roller to fuse the hydrophobic polymeric coating to the photographic element wherein the siloxanes have a ratio of difunctional to trifunctional units of 1:1 to 1:2.7 and at least 90% of the total number of functional units in the siloxanes are difunctional and trifunctional units. The siloxane have a weight average molecular weight of 5,000 to 50,000 grams/mole, and an alkyl to aryl ratio of 1:0.1 to 1:1.2; and, coated on the intermediate layer, a surface layer that comprises a silsesquioxane polymer.

The present invention provides a fuser belt comprising a substrate and a coating on the substrate, the coating comprising a resin made by curing a composition comprising siloxanes having a ratio of difunctional to trifunctional units of 1:1 to 1:2.7 and at least 90% of total number of functional units of the siloxanes are difunctional and trifunctional units, a weight average molecular weight of 5,000 to 50,000, and an alkyl to aryl ratio of 1:0.1 to 1:1.2; and, coated on the intermediate layer, a surface layer that comprises a silsesquioxane polymer.

In an alternative embodiment, Although the described cross-linked silicone resin has excellent properties as an adhesive layer between the polyimide substrate and the silsesquioxane surface layer of the belt, the present invention discloses an primer adhesion promoter to avoid the inherent brittle properties of the highly cross-linked silicone resin. For example, epoxy primer can be applied to the substrate, prior to the application of the release coating. Examples of commercially available primers are W-66, epoxy primer from Emerson and Cuming Co.

In certain embodiments, the silsesquioxane layer can be directly applied to the substrate. It provides some degree of adhesion desired to the substrate layer without the cost of applying intermediate layer.

This fuser belt provides high gloss, long-life, and good release of the fuser for heat-fixing a heat-softenable polymer wherein a protective overcoat for a photographic element. The protective overcoat is formed by the steps of providing a photographic element having at least one silver halide light-sensitive emulsion layer; applying a coating comprising hydrophobic polymer particles having an average size of 0.01 to 1 microns, over the at least one silver halide light-sensitive emulsion layer. The silver halide light sensitive emulsion layer is developed to provide an imaged photographic element. The hydrophobic polymer particles are then fused to form a protective overcoat. In an alternate method, hydrophobic polymer particles having an average size of 3 to 10 microns are electrostatically bound to the outer emulsion layer.

DETAILED DESCRIPTION OF THE INVENTION

The fuser belt used in the method of this invention comprises a substrate over which a coating comprising a silicone resin is coated. The substrate can comprise metal, such as, stainless steel, steel, nickel, copper, and chrome, or a polymer, such as, polyimide, polyester, polycarbonate, and polyamide, or mixtures or combinations of the listed materials. The substrate can be a smooth sheet or a meshed material, preferably it is a smooth sheet. The substrate is preferably a seamless endless belt; however, belts having seams can also be used. The thickness of the substrate is preferably 50 to 200 micrometers, more preferably 50 to 100 micrometers and most preferably 50 to 75 micrometers.

The silicone resins in the coating on the substrate can comprise monofunctional, difunctional, trifunctional and tetrafunctional units or units having mixtures of these functionalities. Monofunctional units can be represented by the formula $—(R)_3SiO_{0.5}$. Difunctional units can be represented by the formula $—(R)_2SiO—$. Trifunctional units can be represented by the formula $—RSiO_{0.5}$. Tetrafunctional units can be represented by the formula $—SiO_2—$. R in the formulas independently represents alkyl groups preferably having from 1 to 8 carbons, more preferably 1 to 5 carbons or aryl groups preferably having 4 to 10 carbons in the ring(s), more preferably 6 carbons in the ring(s). The siloxanes used to form the silicone resin comprise at least some R groups which are alkyl groups, and some R groups which are aryl groups. Mixtures of different alkyl groups and different aryl groups may be present in the siloxanes. The alkyl and all groups can comprise additional substituents and heteroatoms, such as, halogens, in for example a fluoropropyl group, and alkyl groups, in for example a methylphenyl group. The alkyl groups are preferably methyl, ethyl, propyl, isopropyl, butyl, isobutyl, tert-butyl, pentyl, more preferably methyl, ethyl, propyl, and isopropyl, most preferably methyl. The aryl groups are preferably phenyl, diphenyl, or benzyl, more preferably phenyl. The silicone resins have an alkyl to aryl ratio of 1:0.1 to 1:1.2; more preferably 1:0.3 to 1:1.0; most preferably 1:0.4 to 1:0.9. The silicone resin has a ratio of difunctional to trifunctional units of 1:1to 1:2.7, more preferably 1:1.5 to 1:2.5, most preferably 1:1.8 to 1:2.3 and at least 90% of total number of functional units in the silicone resin are difunctional and trifunctional units, more preferably at least 95% of total number of functional units in the silicone resin are difunctional and trifunctional units, most preferably at least 98% of total number of functional units in the silicone resin are difunctional and trifunctional units. The preferred silicone resins comprise substantially only difunctional, trifunctional and tetrafunctional units, meaning that the preferred silicone resins comprise less than 1% monofunctional units of the total number of functional units in the silicone resin. The most preferred silicone resins comprise substantially only difunctional and trifunctional units, meaning that the most preferred silicone resins comprise less than 1% monofunctional and tetrafunctional units of total number of functional units in the silicone resin. The percentages of the functionalities in the silicone resin can be determined using $S^{29}$) NMR.

The silicone resin is made by curing a composition comprising siloxanes. Siloxanes can be monofunctional, difunctional, trifunctional and/or tetrafunctional silicone polymers. The siloxanes are preferably hydroxy-terminated silicone polymers or have at least two hydroxy groups per siloxane. The weight average molecular weight of the siloxanes used to make the thermoset silicone resin is preferably 5,000 to 50,000 grams/mole (g/mol), more preferably 6,000 to 30,000 g/mol, most preferably 7,500 to 15,000 g/mol. Even more preferred are siloxanes having a weight average molecular weight of 7,500 to 10,000 g/mol, and more preferably 7,500 to 8,500. The weight average molecular weight is determined by Size Exclusion Chromatography (SEC). Once the silicone resin is cured, typically by thermosciting, it is difficult to determine the weight average molecular weight of the siloxanes used to form the silicone resin; however, the functional units and alkyl to aryl ratio of the siloxanes will be the same for the silicone resin and the siloxanes used to make the silicone resin.

The silicone resin which is preferably highly crosslinked can be prepared as described in numerous publications. The silicone resins used in this invention are hard, brittle, and highly crosslinked, as compared to silicone elastomers which are deformable, elastic, and highly crosslinked. One method to form the silicone resin is by a condensation reaction as described in, for example, D. Sats, Handbook of Pressure Sensitive Adhesive Technology, 2nd Ed., pp. 601–609, Van Nostrand Reinhold (1989). Other references which disclose the preparation of these highly crosslinked silicone resins are Kirk-Othmer, Encyclopedia of Chemical Technology, 3rd Ed., Vol. 20, pp. 940–962; and Lichtenwalner and Sprung, Bikales, Ed., Encyclopedia of Polymer Science and Technology, Vol. 12, Interscience Publishers, (New York 1970) pg. 464. Useful silicone resins are commercially available, such as, DM 30036 and DM 30020 available from Acheson Colloids Company, and DC-2531 available from Dow Corning.

Although the described cross-linked silicone resin has excellent properties as an adhesive layer between the polyimide substrate and the silsesquioxane surface layer of the fusing belt, the present inventors have found that the highly crosslinked silicone resin is brittle and may crack when the fusing belt is flexed repeatedly. In accordance with the invention, therefore, a surfactant plasticizer is incorporated in the silicone composition before it is coated and cured on the polyimide substrate. In general, compounds known for use as surfactants in silicone coating compositions, can serve as plasticizers and coating aids or surfactants for the silicone composition that is coated on the polyimide belt and thereafter cured. Examples of commercially available compounds of this kind include the compound available from Geleste Corporation as DMS-C25 surfactant, which is a polyethylene oxide-polydimethyl siloxane copolymer. More particularly, such preferred surfactants can be described as polyethylene oxide end-capped polydimethylsiloxanes having terminal hydroxy groups. Other classes of suitable surfactants are polydimethylsiloxanes having terminal amino or epoxy groups. The amount of surfactant is preferably in the range from about 1 to 8 percent by weight of the coating composition and, most, preferably is in the range from about 2 to 4 weight percent.

The surface coating or layer for the fusing belt of the invention is a silsesquioxane polymer. It has excellent toner release properties without the use of a release oil, excellent wear properties and can form a toner image of high gloss, namely, a gloss of at least 90 at 20°. Advantageously, the image gloss can be even higher, e.g., more than 95 at 20°, with the fusing belt of the invention. Gloss can be measured using a BYK Gardner Micro Gloss Meter at a setting of 20°, using the procedure of ASTM-523-67. The silsesquioxane does not adhere well to a polyimide belt but, when used in the novel combination of the invention, it adheres well to the highly cross-linked silicone resin that forms the intermediate or adhesive layer between the polyimide substrate and the surface layer.

Silsesquioxanes are a class of inorganic/organic glasses that can be formed at moderate temperatures by a procedure commonly referred to as a "sol-gel" process. In the sol-gel process, silicon alkoxides are hydrolyzed in an appropriate solvent, forming the "sol"; then the solvent is removed, resulting in a condensation and the formation of a cross-linked "gel." A variety of solvents can be used. Aqueous, aqueous-alcoholic, and alcoholic solvents are generally preferred. Silsesquioxanes are conveniently coated from acidic alcohols, since the silicic acid form, $RSi(OH)_3$, is quite stable in solution for months under ambient conditions. The extent of condensation is related to the amount of curing a sample receives, temperature and time being among the two most important variables.

Silsesquioxanes can be represented by the formula $(RSiO_{1.5})_n$, where R is an organic group and n is the number of repeating units. Thus, the prefix "sesqui" refers to a one and one-half stoichiometry of oxygen. The polymers can be prepared by the hydrolysis and condensation of trialkoxysilanes. U.S. Pat. No. 4,027,073 to Clark teaches the use of silsesquioxanes as abrasion resistant coatings on organic polymers. Typical applications include scratch resistant coatings on acrylic lenses and transparent glazing materials; the cited patent teaches that a preferred thickness for good scratch resistance is from 2 to 10 micrometers. U.S. Pat. No. 4,439,509 to Schank teaches photoconducting elements for electrophotography that have silsesquioxane coatings having a thickness of 0.5 to 2.0 micrometers. This thickness is purported to optimize electrical, transfer, cleaning and scratch resistance properties. This teaching contrasts with that of U.S. Pat. No. 4,027,073, which teaches that a preferred thickness of a silsesquioxane layer for good scratch resistance is from 2 to 10 micrometers. U.S. Pat. No. 4,923,775 to Shank teaches that methylsilsesquioxane is preferred since it produces the hardest material in comparison to other alkylsilanes. U.S. Pat. No. 4,595,602 to Schank teaches a conductive overcoat of cross-linked "siloxanol-colloidal silica hybrid" having a preferred thickness of from 0.3 to 5.0 micrometers. All of these cited patents are incorporated herein by reference.

The formula $(RSiO_{1.5})_n$ above, which is sometimes written $[Si(O_{1/2})_3R_n]$ is a useful shorthand for silsesquioxanes but, except as to fully cured silsesquioxane, it does not fully characterize the material. This is important, since silsesquioxanes can be utilized in an incompletely cured state. An additional nomenclature, derived from one described in R. H. Glaser, G. L Wilkes, C. E. Bronnimann; *Journal of Non-Crystalline Solids,* 113 (1989) 73–87; uses the initials M, D, T, and Q to designate silicon atoms bonded to 1, 2, 3, or 4 oxygen atoms, respectively. The designation T is subdivided as follows, to identify the number of bonds to other silicon atoms:

| Structure | Designation |
|---|---|
| 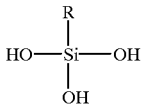 | $T^0$ |
| 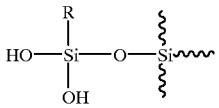 | $T^1$ |
| 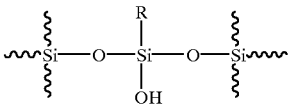 | $T^2$ |
| 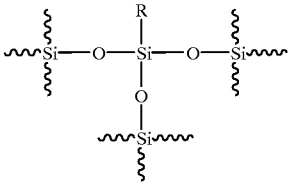 | $T^3$ |

In fully cured silsesquioxanes, substantially all silicons are $T^3$. The extent of curing of the silsesquioxane can be quantified as the ratio of $T^2$ to $T^3$. This ratio is designated herein: "$T^2$-silicon/$T^3$-silicon ratio" or "$T^2/T^3$". The value of $T^2/T^3$ decreases with an increase in cure, and vice versa.

In the silsesquioxanes having the most advantageous properties as a toner fusing belt surface layer in accordance with the invention, the C:Si ratio is greater than about 2:1 and the $T^2/T^3$ ratio is from about 0.5:1 to about 0.1:1. They can be represented by the following structure:

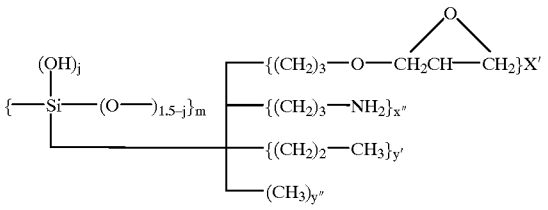

j is from 0 to about 0.5, m is greater than 10;

x' is from about 5 to about 30 mol %;

x" is from about 2 to about 10 mol %;

y' is from about 40 to about 90 mol %; and y" is from 0 to about 55 mol %.

The silsesquioxane is a large oligomer or a polymer. The value of m, that is, the number of subunits for the silsesquioxane is greater than 10. Like highly cross-linked polymers, there is theoretically no upper limit on the number of subunits, and the value of m can be a very large number.

The silsesquioxane surface layer of the fusing belt of the invention preferably contains a surfactant that improves the wetting and adhesion of the surface layer to the intermediate cross-linked silicone layer. In general, surfactants known for use in the coating of aqueous silicone composition can be used. Preferred surfactants are methyl end-capped polydimethylsiloxanes having a polyalkyleneoxide side chain. Especially preferred among commercially available surfactants of this kind are Dow Corning® 190 and 193 surfactants, which are available from Dow Corning Co. and are reported to be silicone glycol copolymers, specifically, dimethylsiloxane-ethylene oxide copolymers, of the formula:

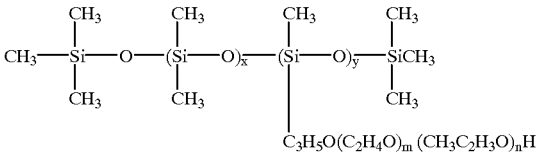

Surfactants of this type comprise, e.g., from 20 to 70 weight percent ethylene oxide repeating units and have viscosities in the range from 400 to 1600 cSt at 25° C.

Another useful surfactant for the silsesquioxane polymer coating is a material marketed by OSi Specialties, Inc., Danbury Conn., as Silwet L-7002 lubricant, and reported to be a poly(alkylene oxide)-copoly(dimethylsiloxane). The amount of surfactant in the silsesquioxane coating composition is preferably in the range from about 0.1 to 6 weight percent and most preferably, from about 0.1 to 2 weight percent.

The fuser belt resin coatings can include fillers. It is preferred that the fillers, if present, are in an amount less than 10 wt. %, more preferably less than 7 wt. %, to maintain a smooth surface of the resin on the fuser belt. Examples of useful fillers include alumina, silica, cupric oxide, and stannic oxide. In general, non-filled coatings produce fused toner images of higher gloss than do filled coatings.

Although the fusing belt of the invention can vary considerably in dimensions, the preferred thickness of the flexible polyimide substrate is in the range from about 25 to 250 micrometers. The thickness of the cross-linked silicone intermediate layer on the belt is preferably less than 20 micrometers, and most preferably from 1 to 10 micrometers. The thickness of the silsesquioxane surface layer of the belt is preferably from 1 to 30 micrometers and more preferably from 2 to 15 micrometers. The coatings an be applied in known manner but preferably are applied by ring coating. The intermediate layer is dried and cured by heating before applying the surface layer coating.

The fuser belt coating can comprise fillers. It is preferred that the fillers, if present are at an amount less than 3%, more preferably less than 1%, to maintain a smooth surface of the coating on the fuser belt. Examples of useful fillers include aluminum, silica, and copper. The preferred fuser belts of this invention have coatings which do not contain fillers, that is, they are non-filled coatings. The non-filled coatings are preferred, because typically they produce fused toner images having higher gloss.

The thickness of the silicone resin coating on the belt is preferably less than 50 micrometers, preferably 1 to 25 micrometers, most preferably 1 to 15 micrometers. Additional layers can be present on the fuser belt if desired.

It is preferred that the surface energy of the coating is 20 to 30 milliJoules/meter(^2) or less, because low surface energy belts provide better release of toner without the addition of release oils. The fuser belt preferably provides a surface finish of the fused heat-softenable polymer being a protective overcoat for a photographic elements layer of G-20 gloss greater than 70, preferably greater than 80, most preferably greater than 90. The gloss measurements can be determined using a BYK Gardner micro glossmeter set at 20 degrees by the method described in ASTM-523-67.

The substrates of the fuser belts are preferably solvent cleaned prior to coating the substrates with the release coating. The release coatings are preferably prepared by making a solvent solution comprising the siloxanes and coating the solution onto the clean substrate by conventional coating techniques, such as, ring coating, dip coating, and spray coating. After coating the substrates with the release coating solution, the coated substrates are preferably placed in a convection oven at a temperature of 150 deg. C. to 350 deg. C., for 10 minutes to 3 hours, preferably causing the siloxanes to undergo condensation reactions to form the silicone resin. The higher the cure temperature the shorter the cure time.

Although the described cross-linked silicone resin has excellent properties as an adhesive layer between the polyimide substrate and the silsesquioxane surface layer of the belt, the present invention discloses an primer adhesion promoter to avoid the inherent brittle properties of the highly cross-linked silicone resin. For example, epoxy primer can be applied to the substrate, prior to the application of the release coating. Examples of commercially available primers are W-66, epoxy primer from Emerson and Cuming Co.

In certain embodiments, the silsesquioxane layer can be directly applied to the substrate. It provides some degree of adhesion desired to the substrate layer without the cost of applying intermediate layer.

Fuser belts of this invention can be any size and can be used in any fuser belt system which comprises a fuser belt. Preferably the fuser belt system comprises a fuser belt which is trained around two or more rollers, and is in pressurized contact with another fuser member, preferably either another fuser belt or a fuser roller. Fuser belts of this invention can be used to contact the heat-softenable polymer being a protective overcoat for a photographic elements.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Photographic elements protected in accordance with the present invention may also include a magnetic recording material as described in Research Disclosure, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, The Theory of the Photographic Process, 4th Edition, Macmillan, N.Y., 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The invention will be better understood with reference to the following examples:

EXAMPLES

The preparation of a silsesquioxane polymer useful as a surface layer of a fusing belt of the invention is illustrated by the following example.

Example 1

To a 2 liter Erlenmeyer flask equipped with a magnetic stirrer was added 184.35 g of propyltrimethoxysilane, followed by 61.25 g of methyltrimethoxysilane, 61.32 g of 3-glycidoxypropyltrimethoxysilane, and 25.20 g of 3-aminopropyltrimethoxysilane. After stirring for a few minutes, 54.18 g of glacial acetic acid was added dropwise from an addition funnel, and 122.79 g of distilled water was added dropwise from an addition funnel. The reaction mixture became exothermic and was cloudy at first but became clear after about half of the water had been added. After completing addition of the water, the flask was covered and the contents stirred overnight. Then 33.8 g of Ludox® silica gel suspension, with pH adjusted from 8.7 to 4.3 by the addition of a few drops of acetic acid, was added dropwise to the reaction flask. The flask was again covered and the contents stirred overnight. Thereafter, 523.25 g of ethanol was added at low flow rate through a funnel to the reaction mixture to obtain a silsesquioxane composition suitable for coating.

The preparation and testing of a fusing belt of the invention are illustrated by the following two examples.

Example 2

A seamless and uncoated polyimide resin belt 823 mm (32.4 inches) in diameter and 254 mm in width (10 inches), manufactured by Gunze Co., was cleaned with anhydrous ethanol and wiped with a lint-free cloth. A mixture of 65.5 g uncured silicone polymer (Acheson RC369, which was filtered before mixing) in 25 g of naphtha VMP containing 1.5 g of DMS-C25 surfactant-plasticizer from Geleste Corp. was stirred for 30 minutes. The resulting solution was ring coated on the polyimide belt at a coating speed of 0.072 inch/second, and the coated belt was flashed at room temperature for 20 minutes. The belt was then cured by heating for 40 minutes, including a 10 minute ramp to 150° C. and 30 minutes at 150° C., to form a highly cross-linked silicone resin layer. Thereafter, 100 g of a 20% water-ethanol solution of silsesquioxane sol-gel, prepared substantially as described in Example 1, was mixed for 30 minutes with 0.7 wt. % of DC 190 surfactant. The mixture was then ring coated over the cured silicone coating on the polyimide belt at 0.25 inch/second. The belt was flashed at room temperature for 20 minutes and was cured at 150° C. for 6 hours, including a 4 hour ramp to 150° C. and 2 hours at 150° C.

Example 3

A seamless and uncoated polyimide belt with 823 mm (32.4 inch) in diameter and 254 mm (10 inch) in width from Gunze Co. was cleaned with anhydrous ethanol and wiped with a lint-free cloth. The belt was dried and ring-coated with an W-66 epoxy resin primer available from Emerson and Cumming Co. The belt was allowed to air-dried and cured at 100° C. for 3 hours Thereafter, 100 g of a 20% water-ethanol solution of silsesquioxane sol-gel, prepared substantially as described in Example 1, was mixed for 30 minutes with 0.7 wt. % of DC 190 surfactant. The mixture was then ring coated over the cured silicone coating on the polyimide belt at 0.25 inch/second. The belt was flashed at room temperature for 20 minutes and was cured at 150° C. for 6 hours, including a 4 hour ramp to 150° C. and 2 hours at 150° C.

Comparative Example 1

A polyimide belt as described in Example 1 was prepared by the following process. The belt was wiped with dichloromethane followed by acetone and ethanol and then allowed to air dry. The belt was tested as described below and the results are in Table 1.

Comparative Example 2

A polyamide belt made of Kapton® from Dupont was prepared by the following process. The belt was wiped with dichloromethane followed by acetone and ethanol and then allowed to air dry. The belt was tested as described below and the results are in Table 1.

Test for Water Resistance

In the case of applying a coating comprising hydrophobic polymer particles having an average size of 0.01 to 1 microns, over the at least one silver halide light-sensitive emulsion layer, the examples and counter examples were screened as to their ability to form the particulate hydrophobic polymer into a uniform continuous film. Receivers were photographic elements made according to U.S. Pat. No. 5,856,051. These photographic element were then fused with the examples and counterexamples indicated. Results are shown in the Table 1 below. Ponceau Red dye is known to stain gelatin through ionic interaction, therefore it is used to test water resistance. Ponceau red dye solution was prepared by dissolving 1 gram dye in 1000 grams mixture of acetic acid and water (5 parts: 95 parts). Samples, without being exposed to light, were processed through the Kodak RA4 process to obtain white Dmin samples. These processed samples were then passed through a set of heated pressurized rollers (fusing) to convert the polymer particles of the overcoat into a water resistant layer. The water permeability was done by soaking fused samples in the dye solution for 5 minutes followed by a 30-second water rinse to removed excess dye solution on the coating surface. Each sample was then air dried, and status A reflectance density on the soaked area was recorded.

TABLE 1

| Sample # | 125° C. Fusing Temperature | 130° C. Fusing Temperature | 135° C. Fusing Temperature |
|---|---|---|---|
| E2 | Resistant | Resistant | Resistant |
| CE1 | Nonresistant | Resistant | Nonresistant |
| CE2 | Nonresistant | Resistant | Resistant |
| E3 | Resistant | Resistant | Resistant |

What is claimed is:

1. A method of fusing a protective layer on a photographic element comprising;

(a) providing a photographic element having a silver halide light-sensitive emulsion layer;

(b) applying a hydrophobic polymeric coating to the silver halide light sensitive emulsion layer; and (c) fusing the hydrophobic polymeric coating to the silver halide light sensitive emulsion layer to form a protective overcoat, the fusing step comprising: passing the photographic element through a nip formed between a heated fuser belt and a roller, wherein the fuser belt has an overcoat comprising:

i) an optional siloxane intermediate layer; and, ii) a silsesquioxane polymer surface layer coated on said intermediate layer.

2. A method according to claim 1 wherein said optional siloxane layer is formed by curing siloxanes having a ratio of difunctional to trifunctional units of 1:1 to 1:2.7.

3. A method according to claim 2 wherein at least 90% of the total number of functional units are difunctional and trifunctional.

4. A method according to claim 1 wherein said optional siloxane intermediate layer has a weight-average molecular weight of 5,000 to 50,000.

5. A method according to claim 1 wherein said optional siloxane intermediate layer has an alkyl to aryl ratio of 1:0.1 to 1:1.2

6. A method according to claim 1 wherein said silsesquioxane polymer surface layer has the formula:

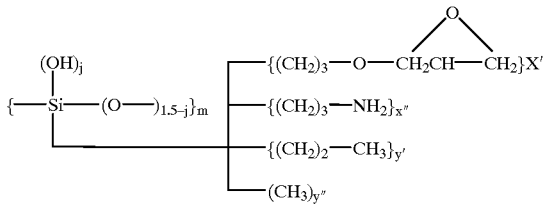

wherein:

j is from 0 to about 0.5, m is greater than 10;

x' is from about 5 to about 30 mol %;

x" is from about 2 to about 10 mol %;

y' is from about 40 to about 90 mol %; and y" is from 0 to about 55 mol %.

7. A method according to claim 1 wherein said optional siloxane intermediate layer contains about 2 to 4 weight percent of a surfactant-plasticizer.

8. A method according to claim 7 wherein said surfactant-plasticizer of the optional intermediate layer is a polyethylene oxide-polydimethyl siloxane copolymer.

9. A method according to claim 1 wherein said silsesquioxane polymer surface layer contains 0.1 to 2 weight percent of a surfactant.

10. A method according to claim 9 wherein said surfactant is a polyalkylene oxide-modified polydimethylsiloxane.

11. A method according to claim 1 wherein said silsesquioxane polymer surface layer further comprises a filler selected from the group consisting of silica, alumina, cupric oxide, and stannic oxide.

12. A method according to claim 11 wherein said filler is silica.

13. A method according claim 5 wherein the alkyl groups are methyl and the aryl groups are phenyl.

14. A method according to claim 1 wherein the optional intermediate layer contains siloxanes that are hydroxy-terminated.

15. A method of fusing a hydrophobic polymeric coating to form a protective overcoat on a photographic element containing a silver halide light sensitive emulsion layer, comprising:

passing the photographic element through a nip formed between a heated fuser belt and a roller to fuse the hydrophobic polymeric coating to the photographic element, the belt having a resin surface made by curing a siloxane and a silsesquioxane polymer;

cooling the fuser belt in contact with the photographic element; and releasing the photographic element from the fuser belt.

16. The method according to claim 15 wherein the siloxanes have a ratio of difunctional to trifunctional units of 1:1 to 1:2.7.

17. The method according to claim 15 wherein the siloxanes have at least 90% of total number of functional units in the siloxanes are difunctional and trifunctional units.

18. The method according to claim 15 wherein the siloxanes have a weight average molecular weight of 5,000 to 50,000 grams/mole and an alkyl to aryl ratio of 1:0.1 to 1:1.2.

19. The method according to claim 1 or 15 that produces a photographic element bearing a water resistant surface with a G-20 gloss of greater than 70.

* * * * *